US007114358B2

(12) United States Patent
Lamb

(10) Patent No.: US 7,114,358 B2
(45) Date of Patent: Oct. 3, 2006

(54) TUBE EXPANDING APPARATUS

(75) Inventor: Kenneth R. Lamb, Garland, TX (US)

(73) Assignee: Arrow Fabricated Tubing, Ltd., Garland, TX (US)

( * ) Notice: Subject to any disclaimer, the term of this patent is extended or adjusted under 35 U.S.C. 154(b) by 0 days.

(21) Appl. No.: 10/752,265

(22) Filed: Jan. 6, 2004

(65) Prior Publication Data

US 2005/0145001 A1 Jul. 7, 2005

(51) Int. Cl.
*B21B 15/00* (2006.01)
*B21D 3/02* (2006.01)

(52) U.S. Cl. ..... 72/125; 72/112; 72/117; 72/370.06

(58) Field of Classification Search ..... 72/37, 72/67, 103, 112, 113, 115, 117, 118, 125, 72/126, 370.06; 29/90.01
See application file for complete search history.

(56) References Cited

U.S. PATENT DOCUMENTS

| | | | | | |
|---|---|---|---|---|---|
| 972,122 | A | | 10/1910 | Merrill | |
| 1,685,472 | A | * | 9/1928 | Watson | 72/113 |
| 1,963,320 | A | | 6/1934 | Wright | |
| 2,346,376 | A | | 4/1944 | Heavener | |
| 2,355,852 | A | | 8/1944 | Fisher | |
| 2,707,511 | A | * | 5/1955 | Franck | 72/117 |
| 3,017,697 | A | * | 1/1962 | Wlodek | 72/377 |
| 3,262,297 | A | | 7/1966 | Samuels et al. | |
| 3,610,016 | A | | 10/1971 | Bultman | |
| 4,087,225 | A | | 5/1978 | Wolcott | |
| 4,132,097 | A | | 1/1979 | Ames | |
| 4,134,286 | A | | 1/1979 | Martin | |
| 4,177,659 | A | | 12/1979 | van Geffen | |
| 4,185,486 | A | | 1/1980 | van Geffen | |
| 4,428,214 | A | | 1/1984 | Head, Jr. et al. | |
| 4,646,548 | A | | 3/1987 | Zimmerli et al. | |
| 4,706,355 | A | | 11/1987 | Kuhns et al. | |
| 4,716,752 | A | | 1/1988 | Diller | |
| 4,925,344 | A | * | 5/1990 | Peres et al. | 405/184 |
| 5,032,073 | A | * | 7/1991 | Moyer, III | 425/208 |
| 5,040,396 | A | * | 8/1991 | Mikhail et al. | 72/117 |
| 5,104,031 | A | | 4/1992 | Wolfe | |
| 5,467,627 | A | * | 11/1995 | Smith et al. | 72/121 |
| 5,564,184 | A | | 10/1996 | Dinh | |
| 5,956,987 | A | * | 9/1999 | Anthoine | 72/21.5 |

FOREIGN PATENT DOCUMENTS

| | | | |
|---|---|---|---|
| GB | 2100027 | * | 4/1982 |
| JP | 57-68230 | * | 4/1982 |

* cited by examiner

*Primary Examiner*—Ed Tolan
(74) *Attorney, Agent, or Firm*—Carr LLP

(57) ABSTRACT

A method and apparatus for expanding a free end of a tube by use of a fluted spinning tool. The fluted spinning tool of the present invention, when rotated at a predetermined speed into the free end of the tube, produces a combination of force, rotation, and heat which results in uniform expansion of the free end of the tube. Further, the fluted spinning tool of the present invention allows for the rapid and efficient production of expanded tube parts, such parts being evenly formed with minimal bias on the expanded free ends of the tubes.

33 Claims, 10 Drawing Sheets

TUBE EXPANDING APPARATUS

FIELD OF THE INVENTION

The invention relates generally to the field of expanding tubular material and, more particularly, to a method and apparatus for expanding the outside diameter (O.D.) of an end of a malleable thin walled tube.

DESCRIPTION OF THE RELATED ART

It can be appreciated that conventional tube expansion processes have been in use with a variety of tubular material applications for many years. A number of the conventional tube expansion processes involve the use of tube expander rollers which are skewed relative to the longitudinal axis of the tube so that the rollers are pulled into the tube as the tube expander rollers rotate. One problem with such conventional tube expanders is that the expanding rollers have a tendency to extrude the tube metal during tube expansion toward the front and rear of the tube as a result of changes in tube wall thickness which occur during the expanding or rolling operation. Other conventional tube expansion methods involve the use of a standard blunt-ended punch type tube expander which is inserted into a tube end with sufficient force to cause expansion of the tube end. Problems encountered with this type of tube expansion method include the following: inconsistently formed parts, weak parts, breakage of parts during the expansion process due to improper alignment of the tube in the tube expansion apparatus, and limits on the degree of expansion which can be achieved.

Therefore, there is a need for a method for a cost-efficient and reliable tube expansion that address at least some of the problems associated with conventional methods particularly in the area of air conditioning liquid return line system manufacturing. In this area, a number of small copper tubes, each tube usually having a 3/16 inch O.D., are used to form liquid return lines in air conditioning coil systems. The end of each 3/16 inch O.D. copper liquid return line or tube is inserted into a standard end of a receiving tube, the standard end of such receiving tube being sized to receive a 3/8 inch O.D. tube. A tight joint must somehow be formed between the two tube ends. Conventional methods for forming such a joint between the two tube ends typically involves manually crimping the larger tube end so as to brace the smaller 3/16 inch O.D. tube end against the inner walls of the larger O.D. tube end. Such conventional methods require significant labor and time, lead to inefficiency, result in increased production costs, and often result in a poorly formed joint between the two tubes.

The tube expansion process, therefore, requires a method and apparatus which can facilitate the rapid and efficient expansion of a tube end so that the expanded tube end can form a tight joint when inserted into another tube end having a slightly larger O.D. Such a method would eliminate the need for manually crimping the larger O.D. tube end and result in the production of strong, evenly formed expanded tube ends. Further, a tube expansion method and apparatus is needed which can overcome the adverse effects often associated with the combination of force, rotation, and heat required in order to accelerate expansion of the O.D. of a tube end.

SUMMARY OF THE INVENTION

An embodiment of the present invention provides a method for expanding the O.D. of an end of a tube. The method of the present invention comprises inserting a fluted spinning tool, while rotating the fluted spinning tool at a predetermined speed, into a free end of a tube substantially along a central longitudinal axis of the tube, such that the fluted spinning tool contacts and rubs against the inner walls of the free end. Friction caused by contact between the fluted spinning tool and the inner walls of the free end of the tube generates heat the heat causes a rise in temperature and is believed to assist in expansion of the tube end. In one embodiment, the tube is formed from copper. An embodiment of the invention provides that the tube is aligned by means of a tube alignment member in which the tube is abutted perpendicularly against a tube stop member, thereby securing the tube in a predetermined axial and radial position. The tube alignment member preferably has an optical switch which detects whether the tube is properly aligned within the tube alignment member. In one embodiment, the tube is secured by means of a tube clamp member, the tube clamp member preferably having an optical switch which detects whether the tube is properly aligned within the tube clamp member.

Another embodiment of the present disclosure provides a fluted spinning tool having helical flutes. The helical flutes of the fluted spinning tool are preferably oriented in the form of a helix, preferably a right-handed helix, and most preferably a 30° right-handed helix. In one embodiment, the helical flutes are grooved into the tube expanding member of the fluted spinning tool at a depth of about 0.065 inches with a rake angle from about 10° to about 12°. The fluted spinning tool is preferably rotated in a direction opposite the twist or helix of the helical flutes. In an embodiment of the invention, the predetermined speed for rotating the fluted spinning tool is between about 4500 rpm and about 9000 rpm, most preferably between about 6000 rpm and about 8000 rpm. In one preferred embodiment, the fluted spinning tool is formed from INCONEL 718. In alternate embodiments, the fluted spinning tool may be formed from sub-micron grade carbide or any other suitable carbide material known to a person of ordinary skill in the art.

In another embodiment of the invention, the fluted spinning tool for expanding the O.D. of an end of a tube is comprised of a conical point which inserts or presses into the free end of a tube, a neck which is continuous with the conical point, a tube expanding member continuous with the neck and having helical flutes, and a shank which is continuous with the tube expanding member and which is received into the chuck of a drill head. In another embodiment, the tube expanding member comprises approximately 2/3 of the fluted spinning tool and the diameter of the conical point is less than 1/2 the diameter of the tube expanding member. In another embodiment, the helical flutes are positioned on the tube expanding member in at least four locations at 90° increments. The helical flutes of the fluted spinning tool are preferably oriented in the form of a 30° right-handed helix. In a preferred embodiment, the helical flutes are grooved into the fluted spinning tool at a depth of about 0.065 inches with a rake angle from about 10° to about 12°. The fluted spinning tool of the present disclosure is preferably rotated in a direction opposite the orientation of the helical flutes. In a preferred embodiment, the fluted spinning tool disclosed herein expands the free end of a tube from a 3/16 inch O.D. to a 3/8 inch O.D. However, in alternate embodiments, the fluted spinning tool may be used to expand tubes of various initial O.D. dimensions to certain expanded O.D. dimensions as needed for particular tube expansion applications.

BRIEF DESCRIPTION OF THE DRAWINGS

For a more complete understanding of the present invention and the advantages thereof, reference is now made to the following descriptions taken in conjunction with the accompanying drawings, in which.

DETAILED DESCRIPTION

Figure 1:
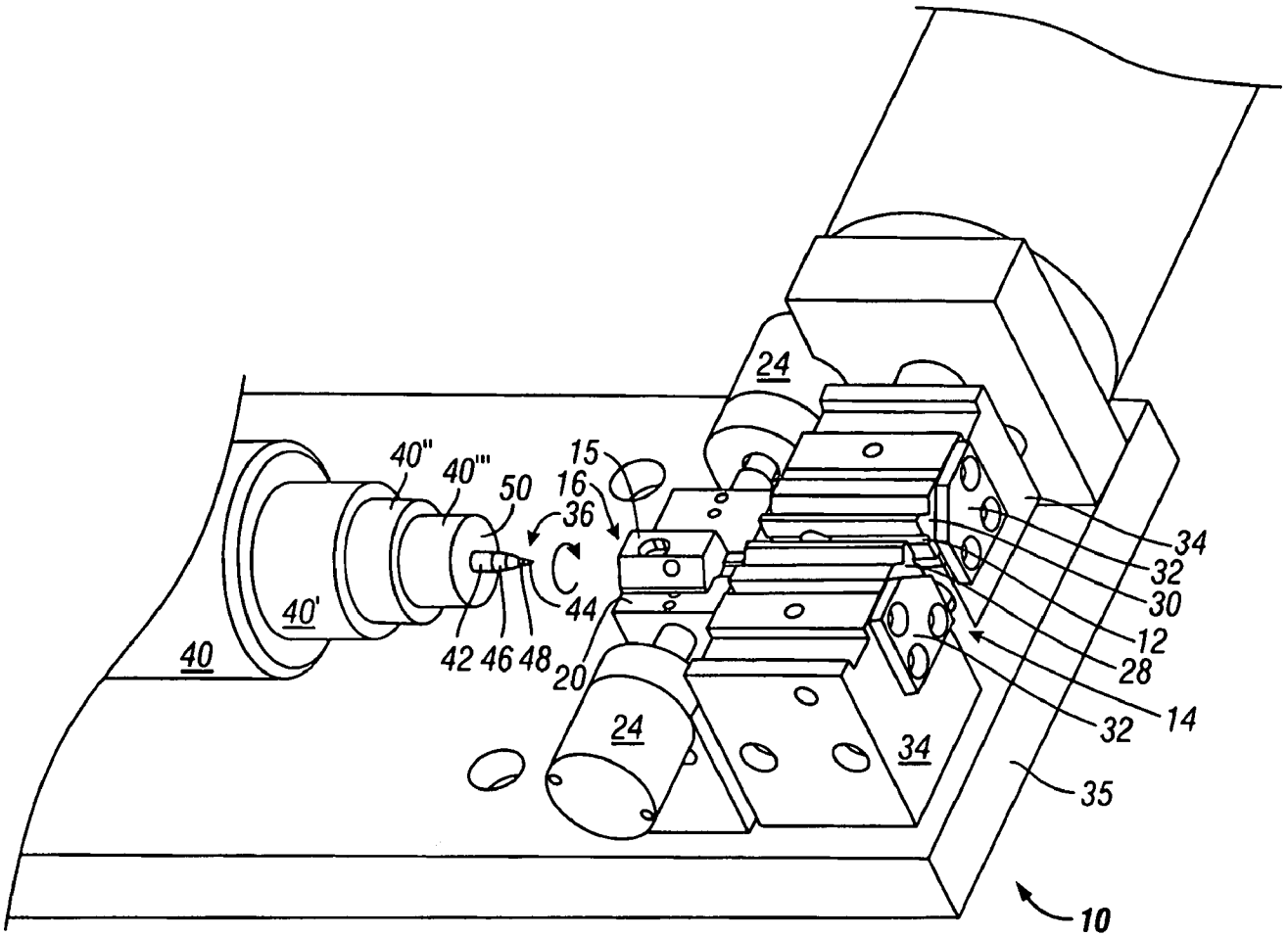
FIG. 1 is a perspective view of a tube clamp member, tube alignment member, and the fluted spinning tool mounted to a drill head.

In the following discussion, numerous specific details are set forth to provide a thorough understanding of the present invention. However, those skilled in the art will appreciate that the present invention may be practiced without such specific details. In other instances, well-known elements have been illustrated in schematic or block diagram form in order not to obscure the present invention in unnecessary detail. The accompanying drawings disclose various embodiments of the tube expansion method and apparatus of the present disclosure wherein like reference numerals have been applied to like elements. Corresponding numerals and symbols in the different figures refer to corresponding parts unless otherwise indicated. Alternate embodiments of the apparatus and method are illustrated in the various figures.

Figure 3:
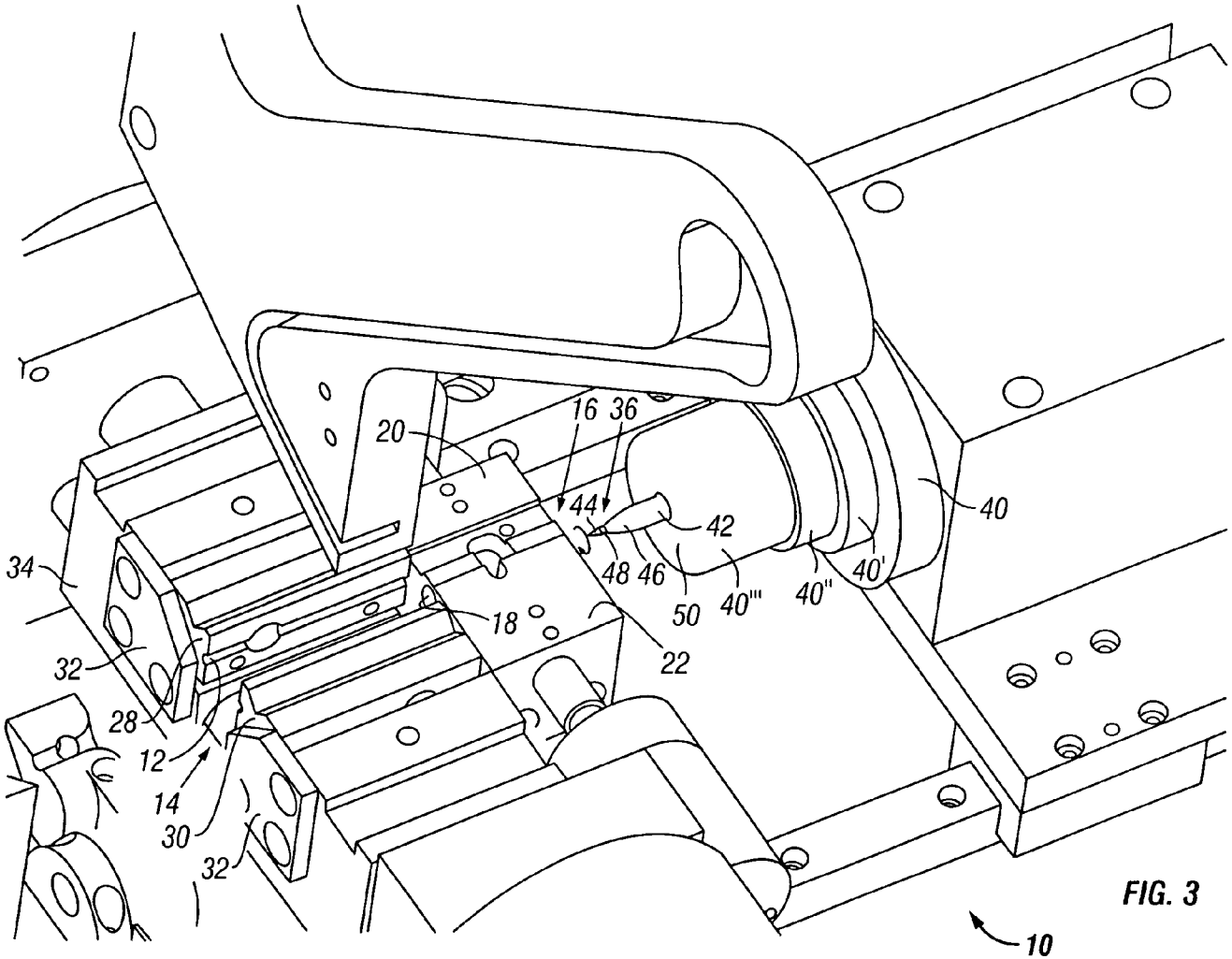
FIG. 3 is a perspective view of blocks for aligning a tube, jaws for clamping a tube clamp and a fluted spinning tool mounted on a retracted drill head.

In FIG. 1 and FIG. 3, the apparatus as used in connection with the method of the present invention is seen in its entirety and is generally referred to by reference number 10. In this embodiment of the tube expansion method disclosed herein, alignment of tube 11 (not shown in FIGS. 1 and 3) is performed in order to minimize any bias of the free end of the tube 11 which may occur during the tube expansion process.

Figure 4:
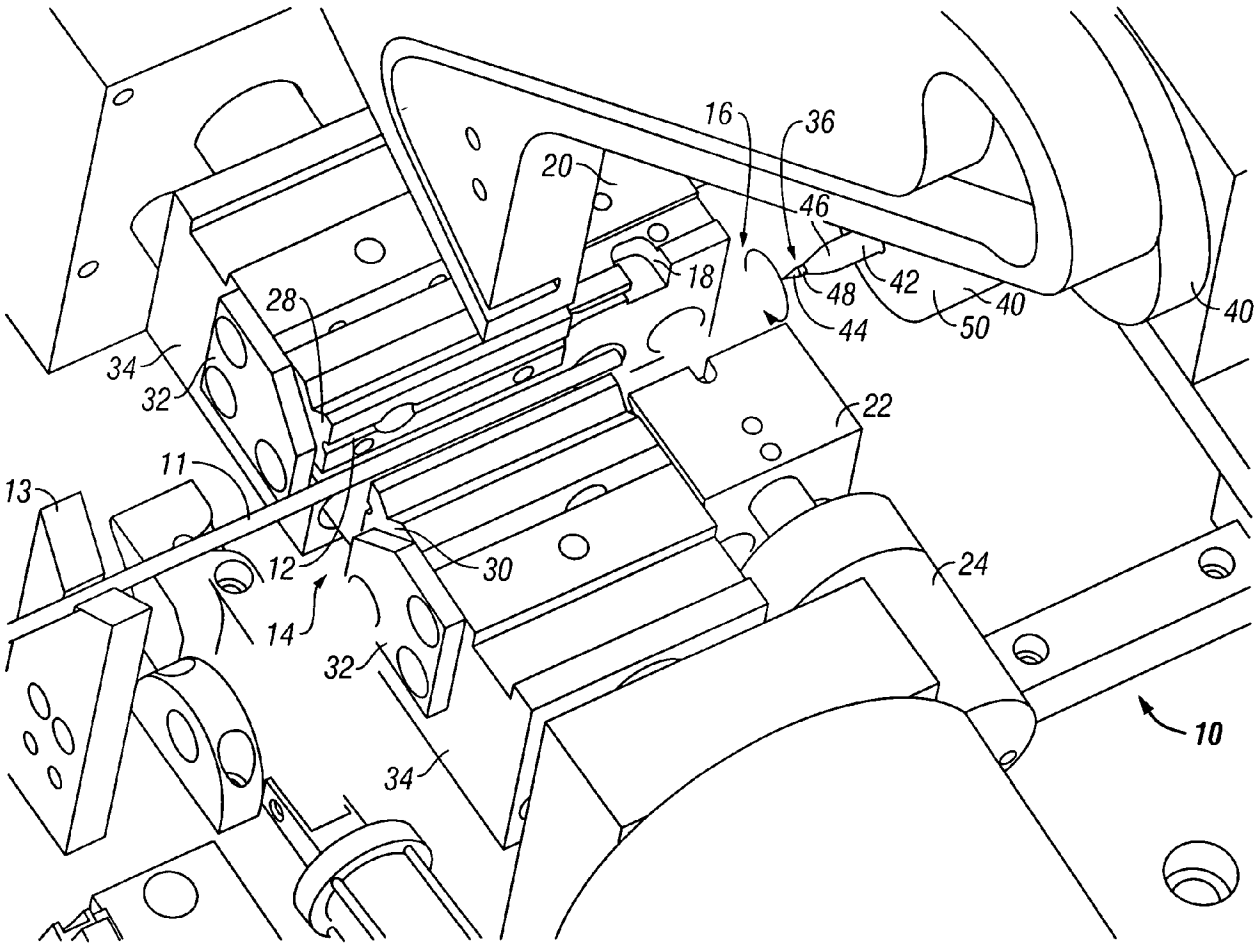
FIG. 4 is a perspective view of the a fluted spinning tool mounted on a retracted drill head and an unexpanded tube on a tube support block, with the tube being passed through the open first jaw and second jaw of the tube clamp member, towards a large alignment block and a small alignment block of a tube alignment member, shown in an open position.
Figure 5:
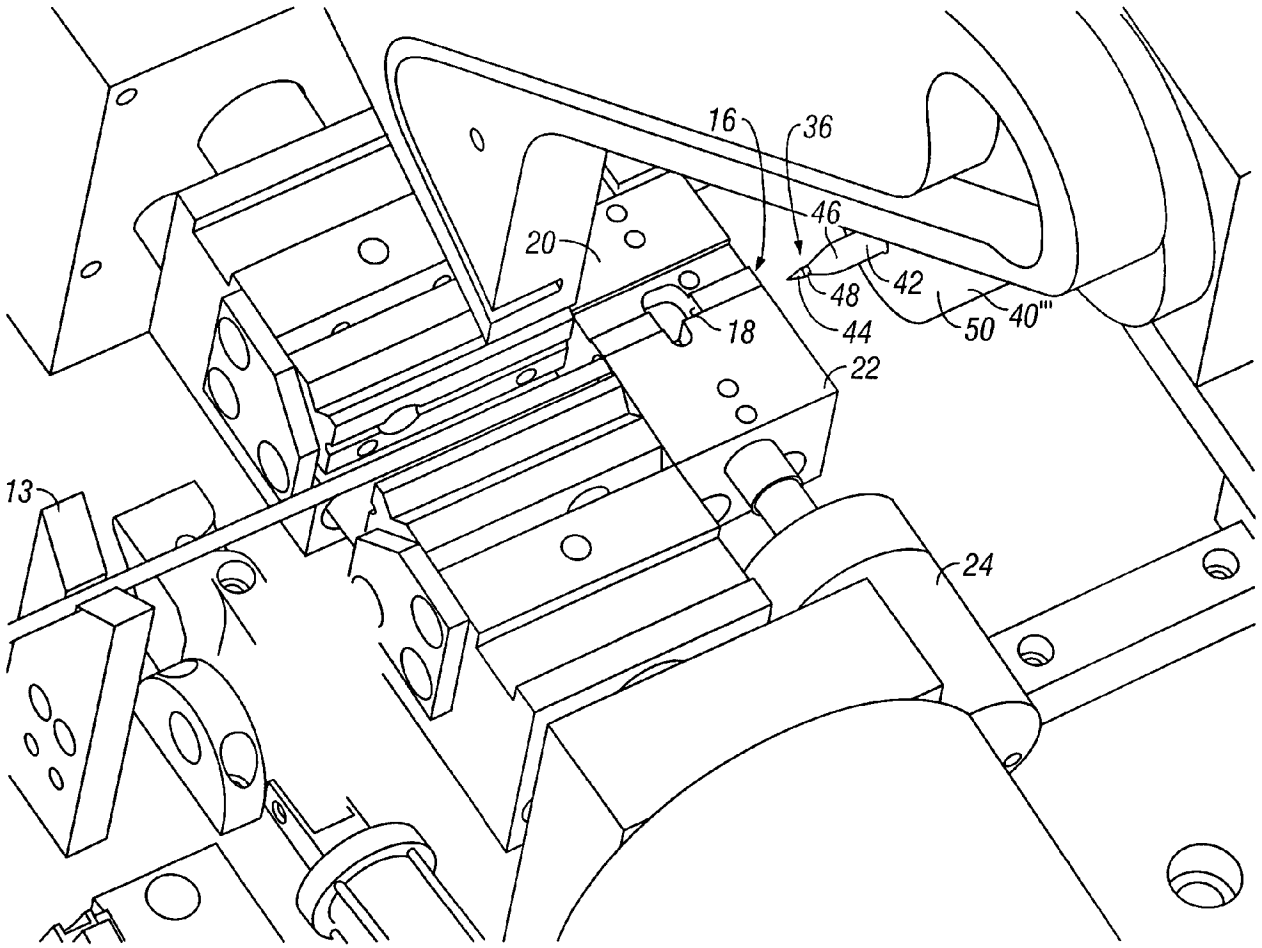
FIG. 5 is a perspective view of a fluted spinning tool mounted to a retracted drill head, as well as an unexpanded tube positioned on a tube support block, passing through an open tube clamp member, and engaged by a closed tube alignment member.

Referring to FIG. 4 and FIG. 5, alignment of tube 11 in a predetermined orientation is achieved by placement of tube 11 on tube support block 13 and passing tube 11 through tube guide 12 of a fixture referred to as tube clamp member 14 until forward progress of the tube 11 is impeded by tube stop member 18 of tube alignment member 16. At such point, tube 11 is abutted perpendicularly against tube stop member 18, thereby securing tube 11 in a predetermined axial and radial position. Tube stop member 18 is formed when small alignment block 20 and large alignment block 22 of tube alignment member 16 are held together in a closed position by operation of pneumatic cylinders 24 (only one of which is shown in FIGS. 4 and 5).

Referring to FIG. 1 proper alignment of tube 11 is detected by optical switches, of any suitable type known in the art, located in both tube clamp member 14 and in optical switch housing 15 of tube alignment member 16. The optical switches function by preventing apparatus 10 from operating unless proper alignment of tube 11 within both tube clamp member 14 and tube alignment member 16 is detected. Once the optical switches detect that tube 11 is aligned properly, operation of apparatus 10 is triggered. (For clarity, optical switch housing 15 is not shown in FIGS. 2–10).

Figure 6:
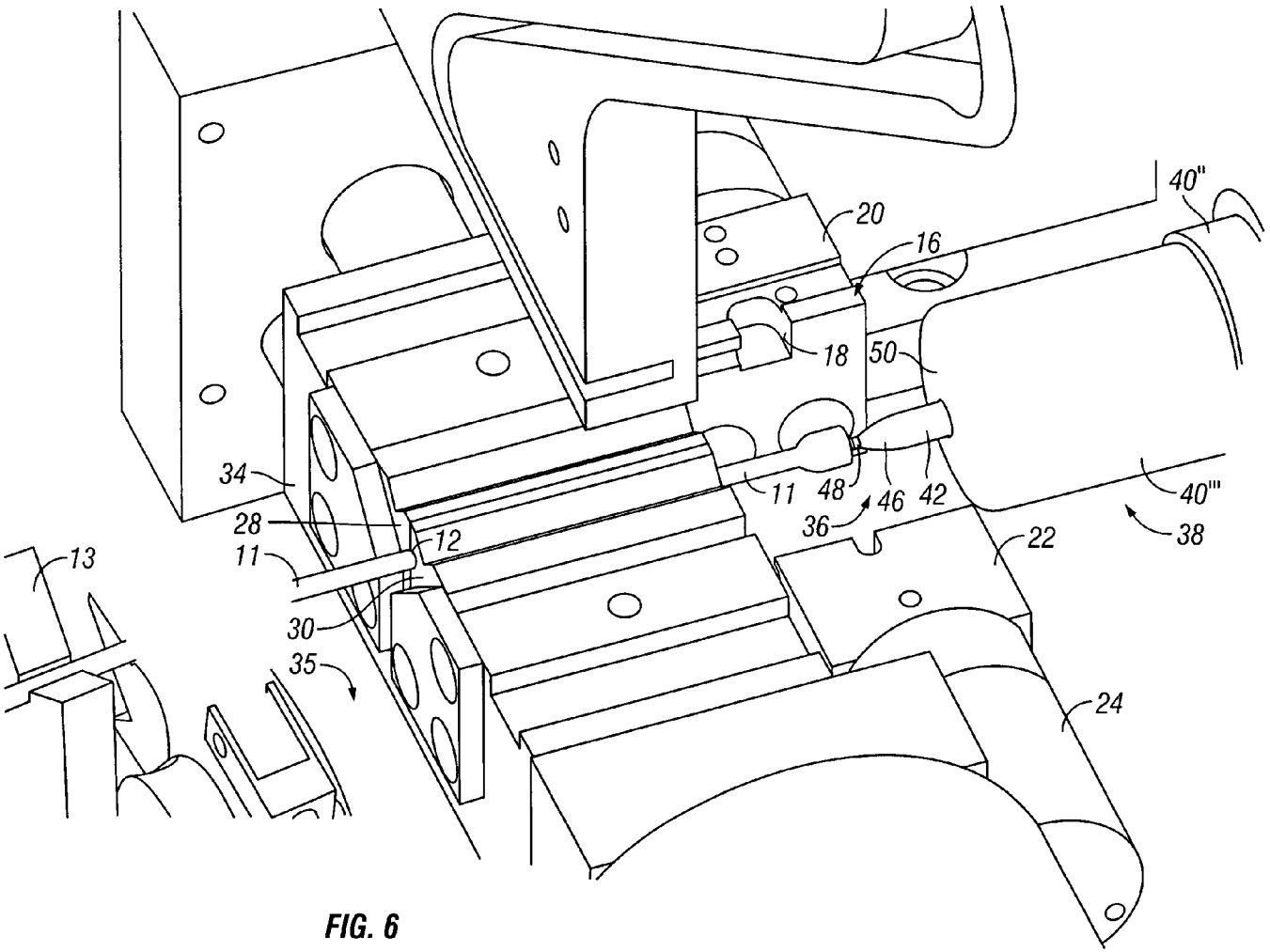
FIG. 6 is a perspective view of a fluted spinning tool inserted into the free end of a tube, with the tube being secured between closed jaws of a tube clamp member and with alignment blocks of the tube alignment member shown apart, in the open position.

As shown in FIG. 6, first jaw 28 and second jaw 30 tube clamp member 14 are brought together or closed automatically, thereby securing tube 11 in a properly aligned position. First jaw 28 and second jaw 30 of tube clamp member 14 are mounted to jaw plate 32 which is secured to clamp block 34, the clamp block 34 being movably mounted on table base 35. Tube clamp member 14, like tube alignment member 16, is operated by any suitable pneumatic means known in the art. After tube clamp member 14 has moved into a closed position, small alignment block 20 and large alignment block 22 of tube alignment member 16 then move apart or open automatically in order to allow space for insertion of fluted spinning tool 36 into the free end of tube 11 to be expanded.

Figure 7:
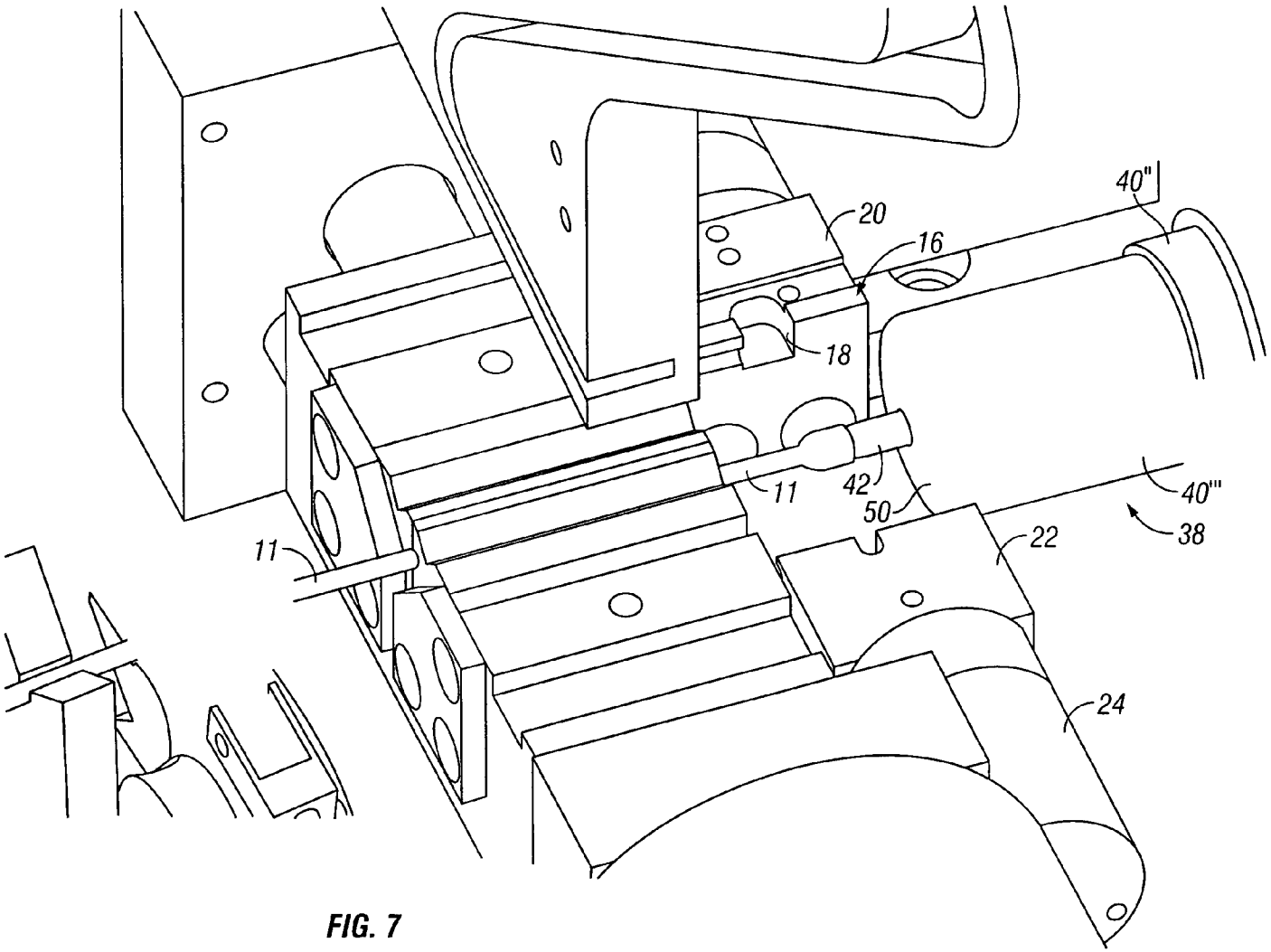
FIG. 7 is a perspective view of a fluted spinning tool fully inserted into a free end of a tube, showing expansion of the free end, with the tube being secured between the closed jaws of the tube clamp member and with the alignment blocks of a tube alignment member shown apart, in the open position.

As can be seen in FIG. 6 and FIG. 7, once small alignment block 20 and large alignment block 22 of tube alignment member 16 have moved apart, then drill head 38 automatically extends horizontally, via extension of concentric cylinders of decreasing diameter 40, 40', 40", and 40'" toward tube alignment member 16. Shank 42 of fluted spinning tool 36, provided in the preferred embodiment of the invention, is mounted in chuck 50 of drill head 38. The extension of drill head 38 occurs by pneumatic means of the type commonly used in conjunction with self-feeding drill heads or spindles as known in the art. It should be understood that any suitable type of self-feeding drill head or spindle known in the art may be used for performing the spinning operation of fluted spinning tool 36 and that drill head 38 shown in FIG. 1 is shown merely for illustrative purposes. In a preferred embodiment, fluted spinning tool 36 is preferably rotated by drill head 38 at a predetermined speed of between about 4500 rpm and about 9000 rpm, most preferably between about 6000 rpm and about 8000 rpm. Such rotation of fluted spinning tool 36 may be accomplished by any number of known pneumatic or electric drill motors having chucks sized to fit shank 42. Fluted spinning tool 36, rotating at the predetermined speed, is thereby inserted or pressed into the free end of tube 11 by extension of drill head 38 in order to expand the free end of tube 11.

Figure 8:
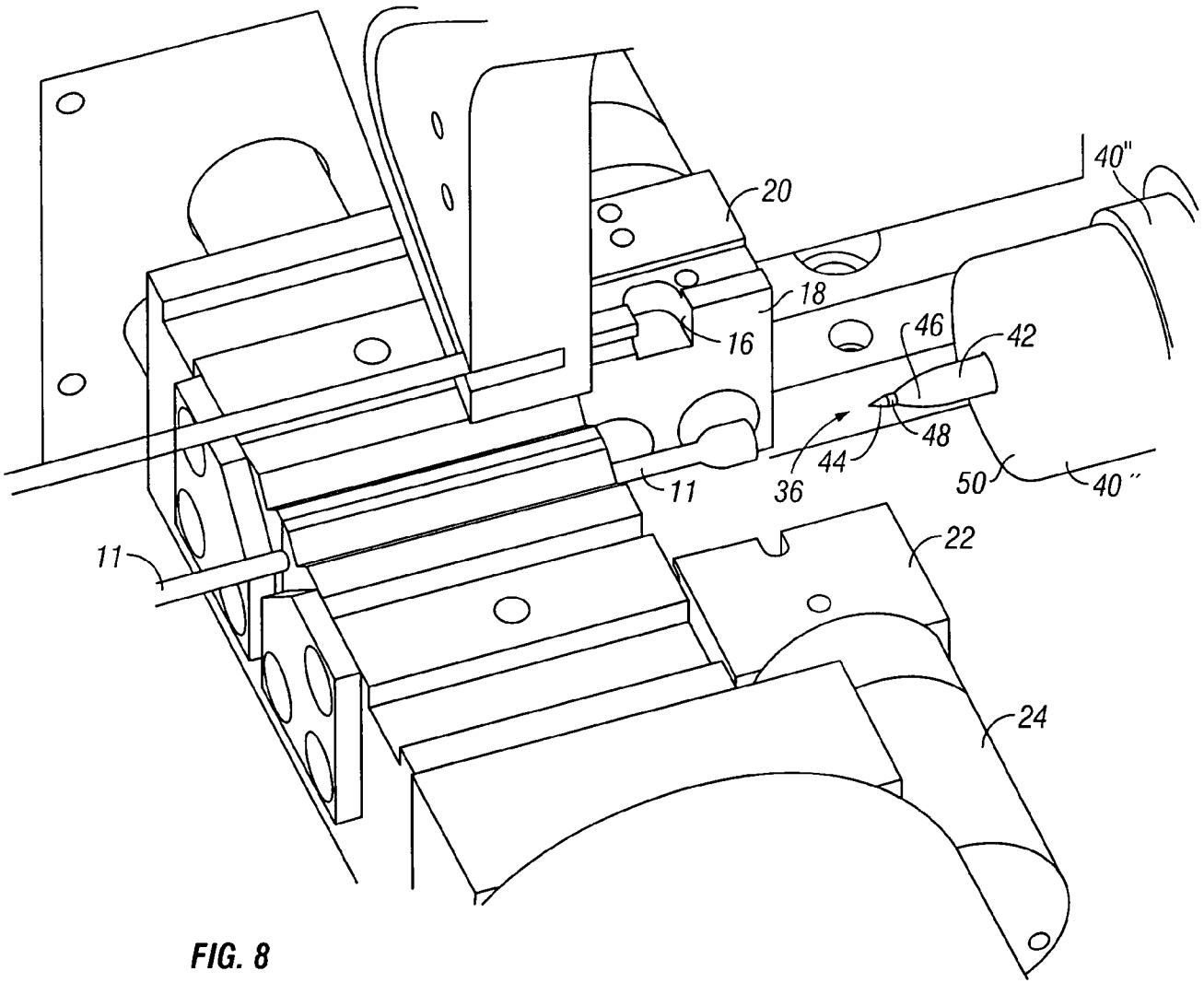
FIG. 8 is a perspective view of the drill head and the fluted spinning tool being retracted subsequent to expansion of the free end of the tube, with the tube remaining secured between closed jaws of the tube clamp member and with alignment blocks of the tube alignment member shown apart, in the open position.
Figure 9:
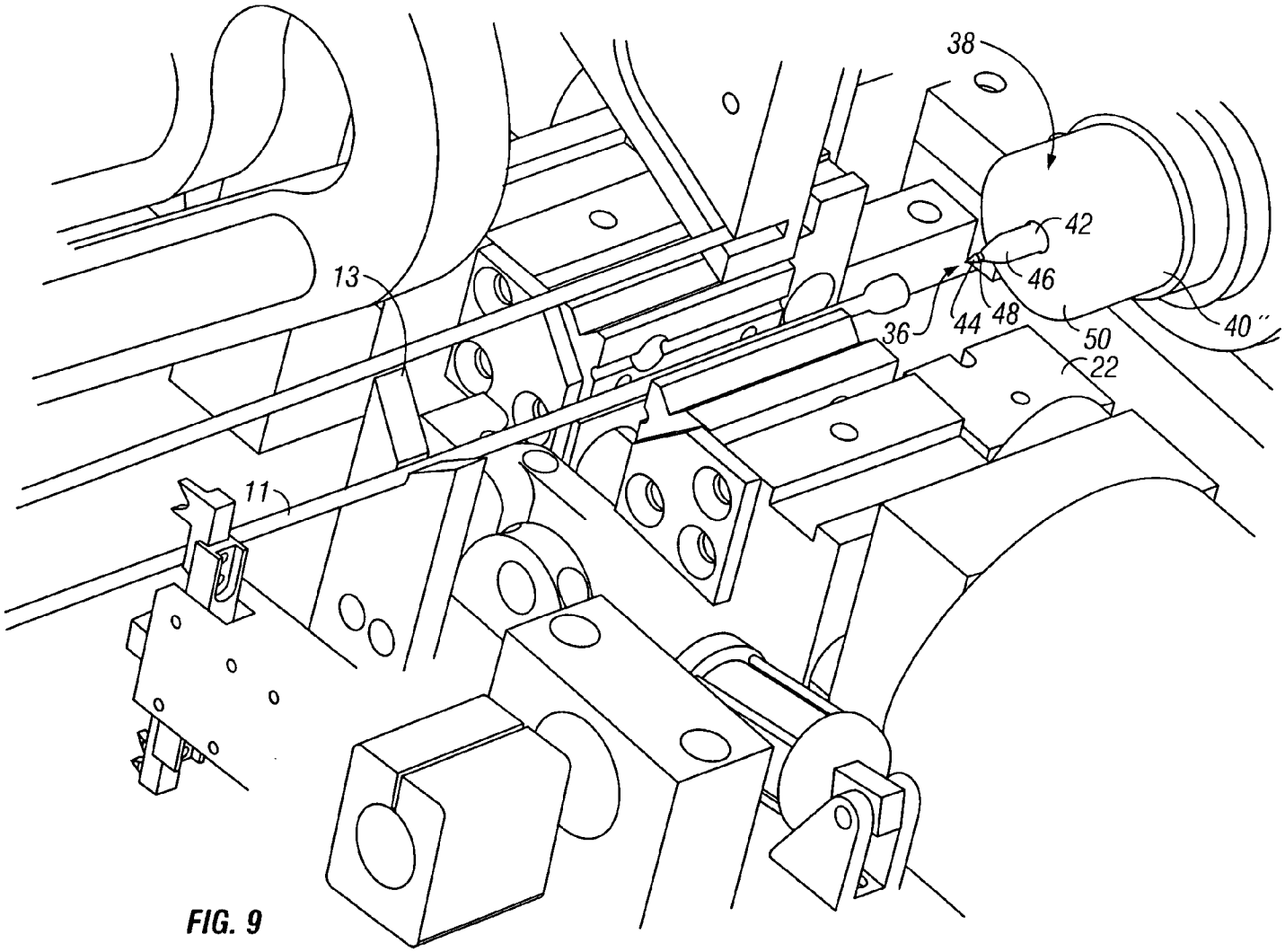
FIG. 9 is a perspective view of the apparatus depicting the first jaw and second jaw of the tube clamp member in the open position allowing release of the tube subsequent to expansion of the free end of the tube by the fluted spinning tool, the small alignment block and large alignment block of the tube alignment member being shown in the open position, the tube being supported by the tube support block, and the fluted spinning tool being shown as mounted on the retracted drill head.
Figure 10:
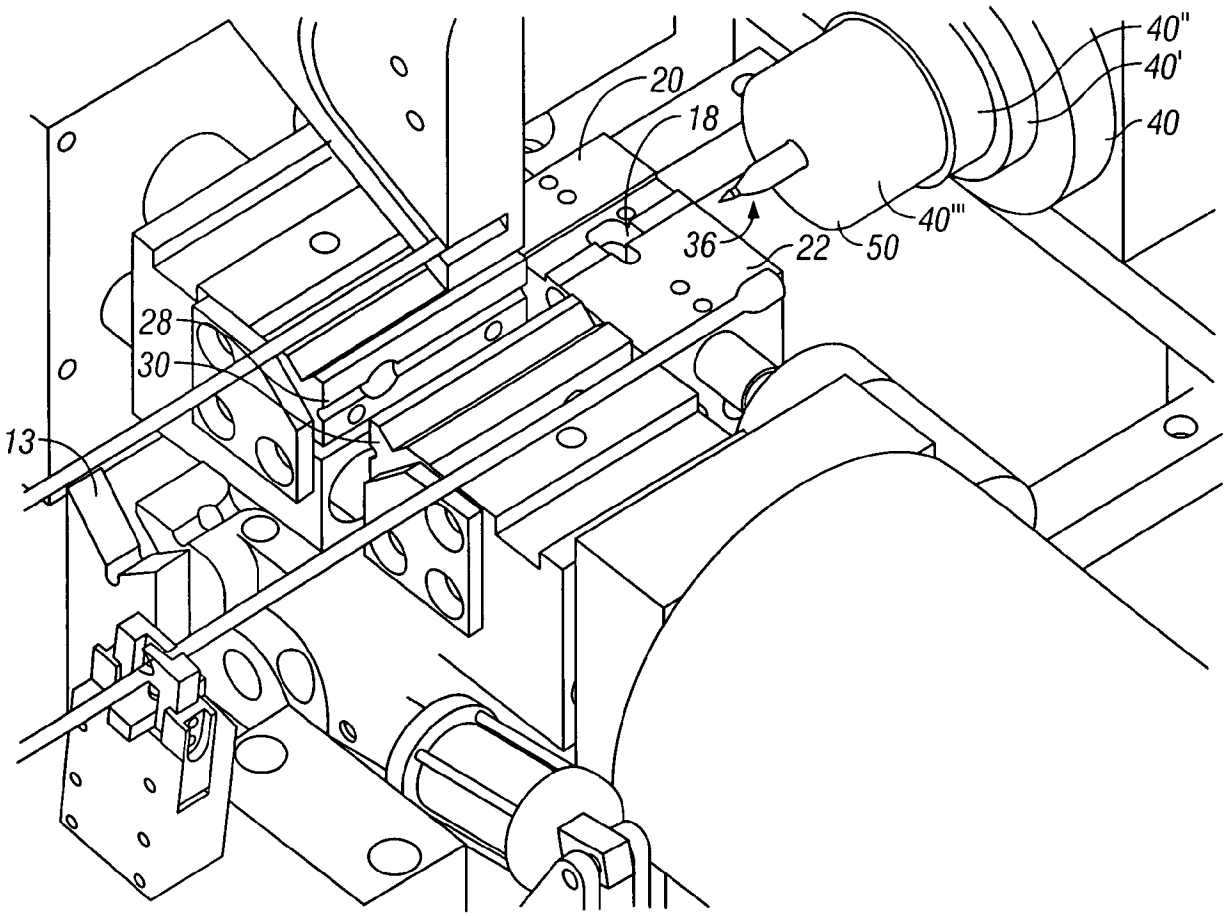
FIG. 10 is a perspective view of the apparatus depicting the tube having been removed from between the open first jaw and second jaw of the tube clamp member, the small alignment block and the large alignment block of the tube alignment member being shown as being brought together in the closed position, and the fluted spinning tool being shown as being mounted on a retracted drill head.

As shown in FIG. 8, once the free end of tube 11 has expanded, then drill head 38 retracts automatically via the aforementioned pneumatic means. It can be seen in FIG. 9 that, after retraction of drill head 38, the first jaw 28 and second jaw 30 of tube clamp member 14 move apart or open automatically by pneumatic means known in the art, thereby releasing tube 11 and leaving only tube support block 13 as support for tube 11. As shown in FIG. 10, once tube 11 is removed from apparatus 10, small alignment block 20 and large alignment block 22 of tube alignment member 16 close automatically to form tube stop member 18 in preparation for the next operation cycle.

Figure 2:
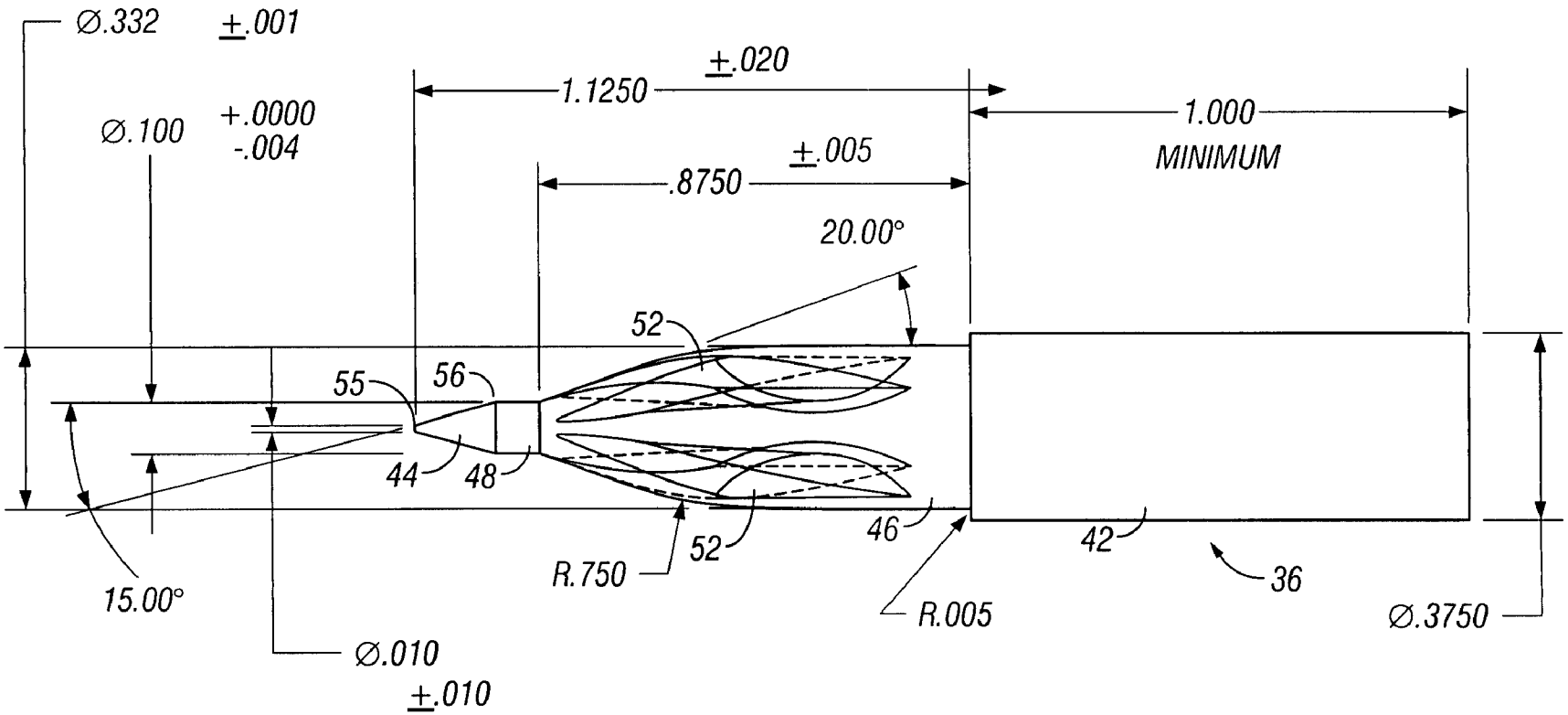
FIG. 2 is a side view of a fluted spinning tool having a conical point, neck, tube expanding member, helical flutes grooved into the tube expanding member, and a shank.

As can clearly be seen in FIG. 2 and FIG. 3, tube expanding member 46 of fluted spinning tool 36 is provided with conical point 44 and neck 48 integrally formed therewith or fixedly secured thereto. In one embodiment, conical point 44 is continuous with neck 48, the neck 48 being centrally located with regard to conical point 44 and situated between conical point 44 and tube expanding member 46. Tube expanding member 46 is continuous with neck 48 and with shank 42, shank 42 being received into chuck 50 of self-feeding drill head 38. Referring to FIG. 2, which depicts one embodiment of the invention, conical point 44 has a taper of 15° with a 0.010 inch diameter and a tolerance of ±0.01 at apex 55 of conical point 44. Base 56 of conical point 44 has a diameter of 0.100 with a tolerance of +0.000 and −0.004. Tube expanding member 46 has a length of 0.875 inches with a tolerance of ±0.005 and a taper of 20° from neck 48 to the 0.332 inch major diameter of tube expanding member 46 which has a tolerance of ±0.001. Shank 42 has a diameter of 0.375 inches and a length of at least about 1.0 inches. The distance between apex 55 of conical point 44 and the beginning of shank 42 is 1.125 inches with a tolerance of ±0.020.

As can be seen in FIG. 2, a plurality of helical flutes 52 are positioned on tube expanding member 46 of fluted spinning tool 36 at 90° increments in at least four locations on tube expanding member 46. Helical flutes 52 are cut or grooved into tube expanding member 46 at an angle of about 30° as a right-handed helix and have a depth of about 0.065 inches deep and a rake angle of between about 10° and about 12°. Helical flutes 52 are positioned so as to engage the sidewalls of the tube during rotation of tube expanding member 46 and exert radial and longitudinal force on the inner walls of tube 11, preferably expanding the O.D. of tube 11 from a 3/16 inch O.D. to a 3/8 inch O.D. It is believed helical flutes 52 function by minimizing the amount of contact between tube 11 and fluted spinning tool 36, thereby preventing fluted spinning tool 36 from acting as a heat sink which, in turn, would slow the heating and expansion of the free end of tube 11. Helical flutes 52 located on fluted spinning tool 36, therefore, provide for accelerated expansion of the free end of tube 11. Further, it is believed that helical flutes 52 of fluted spinning tool 36 help maintain the integrity of the inner walls of tube 11 by allowing for a consistent inner wall thickness to be achieved during expansion of the tube 11.

It will further be understood from the foregoing description that various modifications and changes may be in the preferred embodiment of the present invention without departing from its true spirit. This description is intended for purposes of illustration only and should not be construed in a limiting sense. The scope of this invention should be limited only by the language of the following claims.

The invention claimed is:

1. A method for expanding an outer diameter (O.D.) of an end of a tube having an initial O.D. to a cylindrical shape having a predetermined final O.D. and a significant length comprising the steps of:

aligning a tube in a predetermined orientation with a first end secured in a fixture and a second end as a free end;

inserting a helically fluted spinning tool, while rotating the fluted spinning tool at a predetermined speed, into the free end of the tube along a central longitudinal axis of the tube such that the fluted spinning tool contacts and rubs against the inner walls of the free end to expand the O.D. of the free end; and continuing to insert said tool while said tool is rotating into the end of said tube until the O.D. of a significant length of said tube is expanded to a cylindrical shape having said predetermined final O.D.

2. The method of claim 1, wherein the tube is formed from copper.

3. The method of claim 1, wherein the tube is aligned by means of a tube alignment member in which the tube is abutted perpendicularly against a tube stop member, thereby securing the tube in a predetermined axial and radial orientation.

4. The method of claim 3, wherein the tube alignment member has an optical switch which detects whether the tube is properly aligned within the tube alignment member.

5. The method of claim 1, wherein the first end of the tube is secured by means of a tube clamp member.

6. The method of claim 5, wherein the tube clamp member has an optical switch which detects whether the tube is properly aligned within the tube clamp member.

7. The method of claim 1, wherein said fluted spinning tool has helical flutes.

8. The method of claim 7, wherein the helical flutes are oriented in the form of a helix.

9. The method of claim 8, wherein the fluted spinning tool is rotated in a direction opposite the orientation of the helical flutes.

10. The method of claim 1, wherein the predetermined speed for rotating the fluted spinning tool is between about 6000 rpm and about 9000 rpm.

11. The method of claim 1, wherein the fluted spinning tool is formed from a nickel-chromium alloy.

12. The method of claim 1, wherein the free end of the tube has a 3/16 inch O.D. prior to expansion of the free end.

13. The method of claim 1, wherein the free end of the tube expands from a 3/16 inch O.D. to a 3/8 inch O.D.

14. A method for expanding an outer diameter (O.D.) of an end of a tube having an initial O.D. to a cylindrical shape having a predetermined final O.D. and a significant length comprising the steps of:

aligning a tube in a predetermined orientation within a tube alignment member;

securing the tube at a first end within a tube clamp member while leaving the second end of the tube as a free end;

and inserting a helically fluted spinning tool, while rotating the fluted spinning tool at a predetermined speed, into the free end of the tube along a central longitudinal axis of the tube such that the fluted spinning tool contacts and rubs against the inner walls of the free end to expand an outer diameter (O.D.) of the free end; and continuing to insert said tool while said tool is rotating into the end of said tube until the O.D. of a significant length of said tube is expanded to a cylindrical shape having said predetermined final O.D.

15. The method of claim 14, wherein the tube alignment member aligns the tube by means of a tube stop member against which the free end of the tube abuts perpendicularly, thereby securing the tube in a predetermined axial and radial orientation.

16. The method of claim 14, wherein the tube alignment member has an optical switch which detects whether the tube is properly aligned within the tube alignment member.

17. The method of claim 14, wherein the tube clamp member has an optical switch which detects whether the tube is properly aligned within the tube clamp member.

18. The method of claim 14, wherein the tube is formed from copper.

19. The method of claim 14, wherein the fluted spinning tool has helical flutes.

20. The method of claim 19, wherein the helical flutes are oriented in the form of a 30° helix.

21. The method of claim 20, wherein the fluted spinning tool is rotated in a direction opposite the orientation of the helical flutes.

22. The method of claim 14, wherein the predetermined speed for rotating the fluted spinning tool is about 4500 rpm and about 9000 rpm.

23. The method of claim 14, wherein the fluted spinning tool is formed from a nickel-chromium alloy.

24. A method for expanding an end of a tube comprising the steps of:

aligning a tube in a predetermined orientation within a tube alignment member;

securing the tube at a first end within a tube clamp member while leaving the second end of the tube as a free end;

and inserting a fluted spinning tool, while rotating the fluted spinning tool at a predetermined speed, into the free end of the tube along a central longitudinal axis of the tube such that the fluted spinning tool contacts and rubs against the inner walls of the free end to expand an outer diameter (O.D.) of the free end, wherein the fluted spinning tool has helical flutes that are grooved into the fluted spinning tool at a depth of about 0.065 inches with a rake angle from about 10° to about 12° .

25. A helically fluted spinning tool for expanding an outer diameter (O.D.) of an end of a tube having an initial inside diameter (I.D.) and an initial O.D. to a cylindrical shape having a predetermined final O.D. and a significant length, the fluted spinning tool comprising:

a conical point adapted to insert into a free end of the tube and a neck continuous with the conical point;

a tube expanding member continuous with the neck and having helical flutes having a working surface O.D. that is greater than the initial I.D. of said end of said tube;

and a shank which is continuous with the tube expanding member and which is received into the chuck of a drill head; and a rotator and a displacer operable to rotate said tube expanding member while simultaneously inserting said tube expanding member into said tube a sufficient distance to cause the O.D. of a significant length of said end of said tube to be expanded to a cylindrical shape having said predetermined final O.D.

26. The fluted spinning tool of claim 25, wherein the diameter of the conical point is less than ½ the diameter of the tube expanding member.

27. The fluted spinning tool of claim 25, wherein the helical flutes are oriented in the form of a 30° helix.

28. The fluted spinning tool of claim 25, wherein the helical flutes are positioned on the tube expanding member in at least four locations at 90° increments.

29. The fluted spinning tool of claim 28, wherein the fluted spinning tool is rotated in a direction opposite the orientation of the helical flutes.

30. The fluted spinning tool of claim 25, wherein the fluted spinning tool is rotated at a predetermined speed of between about 4500 rpm and about 9000 rpm.

31. The fluted spinning tool of claim 25, wherein the fluted spinning tool is formed from a nickel-chromium alloy.

32. The fluted spinning tool of claim 25, wherein the fluted spinning tool expands the end of the tube from a 3/16 inch O.D. to a ⅜ inch O.D.

33. A fluted spinning tool for expanding an outer diameter (O.D.) of an end of a tube, the fluted spinning tool comprising:

a conical point adapted to insert into a free end of the tube a neck continuous with the conical point;

a tube expanding member continuous with the neck and having helical flutes;

and a shank which is continuous with the tube expanding member and which is received into the chuck of a drill head;

wherein the helical flutes are grooved into the fluted spinning tool at a depth of about 0.065 inches with a rake angle from about 10° to about 12°.

* * * * *